US009331378B2

(12) United States Patent
Merlin et al.

(10) Patent No.: US 9,331,378 B2
(45) Date of Patent: May 3, 2016

(54) ACTIVE LOAD MODULATION ANTENNA

(75) Inventors: Erich Merlin, Gratkorn (AT); Christoph Chlestil, Frohnleiten (AT); Michael Gebhart, Gratkorn (AT)

(73) Assignee: NXP B.V., Eindhoven (NL)

( * ) Notice: Subject to any disclaimer, the term of this patent is extended or adjusted under 35 U.S.C. 154(b) by 142 days.

(21) Appl. No.: 13/482,930

(22) Filed: May 29, 2012

(65) Prior Publication Data

US 2013/0321230 A1 Dec. 5, 2013

(51) Int. Cl.

| | |
|---|---|
| ***H01Q 7/08*** | (2006.01) |
| ***H01Q 1/22*** | (2006.01) |
| ***H01Q 7/00*** | (2006.01) |

(52) U.S. Cl.

CPC ..... *H01Q 1/2225* (2013.01); *H01Q 7/00* (2013.01); *Y10T 29/49016* (2015.01)

(58) Field of Classification Search

CPC ..... G06K 19/07749; G06K 19/07771; H01Q 1/2216; H01Q 1/22; H01Q 7/00; H01Q 1/2225; H01Q 1/526

USPC ..... 343/866, 742, 787, 788, 841, 893

See application file for complete search history.

(56) References Cited

U.S. PATENT DOCUMENTS

| | | | | |
|---|---|---|---|---|
| 5,574,470 | A * | 11/1996 | de Vall | G06K 7/10336 340/572.7 |
| 7,098,770 | B2 | 8/2006 | Charrat et al. | |
| 7,712,672 | B2 * | 5/2010 | Takahashi et al. | 235/492 |
| 7,764,236 | B2 * | 7/2010 | Hill et al. | 343/702 |
| 7,876,284 | B2 * | 1/2011 | Mizoroki et al. | 343/895 |
| 8,461,993 | B2 * | 6/2013 | Mickle et al. | 340/572.1 |
| 8,466,791 | B2 * | 6/2013 | Goto et al. | 340/572.7 |
| 2008/0100527 | A1 | 5/2008 | Rahim | |
| 2009/0295526 | A1 * | 12/2009 | Mikami et al. | 336/196 |
| 2011/0068178 | A1 | 3/2011 | Gebhart | |
| 2011/0128125 | A1 * | 6/2011 | Kai et al. | 340/10.1 |
| 2012/0071089 | A1 | 3/2012 | Charrat et al. | |

OTHER PUBLICATIONS

Gebhart, M. et al. "Properties of a Test Bench to Verify Standard Compliance of Proximity Transponders", Communication Systems, Networks and Digital Signal Processing, 5 pgs. (Jul. 2008).

Gebhart, M. et al. "Design of 13.56 MHz Smartcard Stickers with Ferrite for Payment and Authentication", Near Field Communication, pp. 59-64 (Feb. 2011).

European Search Report, 13160128.8, Apr. 9, 2014.

* cited by examiner

*Primary Examiner* — Dameon E Levi
*Assistant Examiner* — Hasan Islam

(57) ABSTRACT

Active load modulation antennas for contactless systems typically require the presence of a battery power source in the transponder device. The transponder typically cannot be powered by the reader device alone and also transmit an active load modulation signal. Embodiments in accordance with the invention are disclosed that allow transponder devices to transmit an active load modulation signal when powered only by the reader in the contactless system.

20 Claims, 11 Drawing Sheets

ACTIVE LOAD MODULATION ANTENNA

BACKGROUND OF THE INVENTION

To guarantee interoperability between contactless card readers and transponders, international standards specify the properties of the air interface. For example, ISO/IEC 14443 is the fundamental international standard for proximity cards, ISO/IEC 10373-6 is the test standard for proximity systems, EMVCo is the industry standard for payment and ECMA 340 is the Near Field Communication (NFC) interface and protocol. Conformance of the contactless card readers and transponders to these standards is typically essential and in some instances needs to be certified by an accredited test laboratory. A number of properties are specified for the air interface of contactless products by the international standards. One property is the so-called Load Modulation Amplitude (LMA).

For example, in the communication link from a device in card mode (hereinafter referred to as the transponder device) to a device in contactless reader mode (hereinafter referred to as the contactless reader), the information is communicated using load modulation. Due to the inductive proximity coupling between the loop antenna circuit of the reader and the loop antenna circuit of the transponder device, the presence of the transponder device affects the contactless reader and is typically referred to as the "card loading effect". From the perspective of the contactless reader, a change in resonance frequency and a decrease in the Quality (Q) factor of the resonant circuit occurs. If the contactless reader/transponder device coupling system is viewed as a transformer, the transponder device represents a load to the contactless reader. Modulating the frequency and Q of the transponder loop antenna circuit produces a modulation of the load on the contactless reader. The contactless reader detects this load modulation at the reader antenna as an AC voltage. For systems compliant with ISO/IEC 14443, for example, the load modulation is applied to a sub-carrier frequency (e.g. 0.8475 MHz) of the 13.56 MHz carrier frequency specified by the standard or the 13.56 carrier frequency is directly modulated by the encoded signal for systems compliant with FeliCa, a contactless RFID smartcard system developed by Sony in Japan.

Each standard typically specifies a minimum limit for the load modulation amplitude that needs to be achieved by the transponder device in card mode.

Typically, restrictions such as available space or cost place strict limits on the antenna size. Furthermore, the presence of other components in close proximity to the contactless reader antenna circuit or transponder device antenna circuit effect the antenna circuit resonance properties, typically producing a shift in resonance frequency and decreasing the Q-factor. To address this issue, typically ferrite materials such as sintered or polymer ferrite foils are used for one layer of the construction of transponder and reader antennas. For example, see US Patent Publication 201100068178 A1 incorporated by reference herein.

For transponder devices that are powered only by the contactless reader device, there is typically a physical limitation on the load modulation that may be achieved using conventional methods such as passive switching of a resistor or capacitor to modulate the frequency or Q-factor of the antenna resonance circuit. The physical limitation typically depends on antenna size of the transponder device, the coupling between transponder and reader, the Q-factor of the resonant circuit, the switching time and other parameters. Note, the switching time is fixed for the 847.5 kHz subcarrier frequency in context of the ISO/IEC 14443 standard. These physical limitations allow the generation of a limit curve for the minimum antenna area that can achieve compliance with the minimum load modulation specified by the standards.

The minimum load modulation required can be achieved using a smaller planar loop antenna if the card mode communication is transmitted actively into the contactless reader antenna. Options exist which can induce the same voltage into the contactless reader antenna as is possible using conventional passive amplitude load modulation. For example, one option is to transmit a 13.56 MHz carrier signal that is modulated by the 847.5 kHz subcarrier frequency which is in turn modulated using the encoded data operating in card mode.

However, for active load modulation to work, the active load modulation of the transponder device typically needs to be in phase with the, for example, 13.56 MHz alternating magnetic field emitted by the contactless reader. The contactless reader typically provides the time reference for communication using the contactless interface. Typical transponder devices derive the clock frequency from the exemplary 13.56 MHz carrier signal provided by the contactless reader. Therefore, the signal typically used for the communication link from the transponder device to the contactless reader is in phase with the carrier signal emitted by the contactless reader. For a transponder device actively emitting in card mode with only one antenna, however, it is typically not possible to obtain the time reference from the contactless reader carrier signal.

DETAILED DESCRIPTION

Figure 1A:
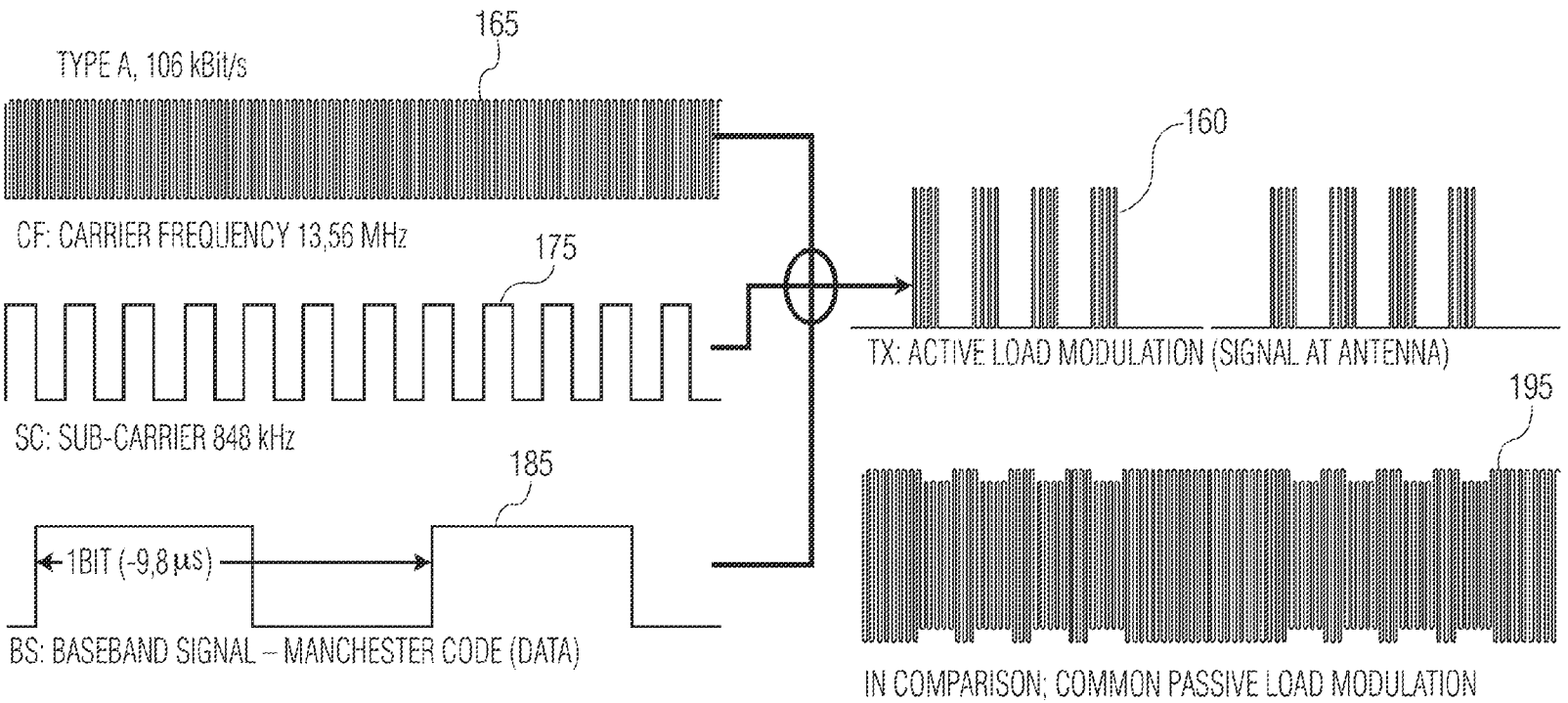
FIG. 1*a* shows active load modulation in accordance with the invention.

In accordance with the invention, a special antenna geometry (e.g. a planar loop, but three dimensional embodiments are also possible) together with a special receiver and driver allow a transponder device to receive the exemplary 13.56 MHz signal from the contactless reader at the same time as the transponder device is transmitting in active card mode. This allows synchronization of the active load modulation signal with the carrier signal transmitted by a contactless reader (not shown) as is shown in FIG. 1*a* for an exemplary carrier frequency of 13.56 MHz and subcarrier frequency of 847.5 kHz. Active load modulation signal 160 uses the logical AND of synchronous carrier wave 165 with subcarrier wave 175

AND baseband signal 185 which employs Manchester coding (e.g. see FIG. 1*a*). A carrier wave at the exemplary frequency of 13.56 MHz is actively transmitted by the contactless reader (not shown) to the transponder device (not shown). Active load modulation signal 160 is emitted from the transponder device and has the same phase relationship in every burst with synchronous carrier wave 165 provided by the contactless reader. Synchronous carrier wave 165 defines the time reference for communications between the transponder and the contactless reader. For comparison, FIG. 1*a* also shows typical passive load modulation signal 195 at the transponder antenna.

Figure 1B:
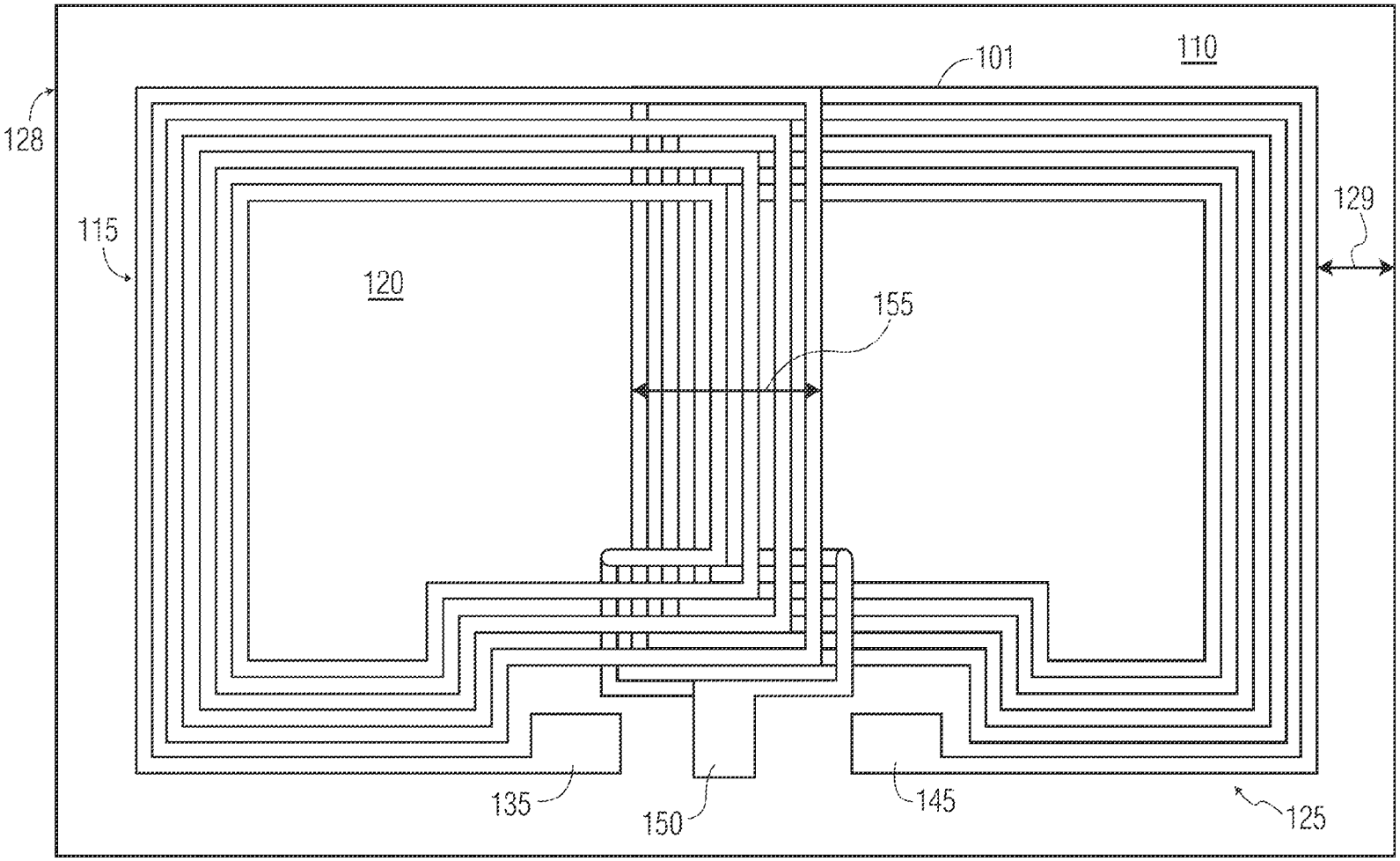
FIG. 1*b* shows an embodiment in accordance with the invention.

FIG. 1*b* shows an embodiment in accordance with the invention where planar loop antenna 110 comprises two individual planar coils 115 and 125. Planar coils 115 and 125 are connected at pad 150 and shifted laterally with respect to each other so that there is nearly zero electromagnetic coupling between coils 115 and 125. Planar coils 115 and 125 are positioned on opposite sides of substrate 120 which may be, for example, polyethylene terephthalate (PET) foil or polyvinyl chloride (PVC) foil. Planar loop antenna 110 on substrate 120 is typically placed over ferrite foil 128. Note that ferrite foil 128 extends distance 129 beyond the last turn of coils 115 and 125. This typically improves the performance (e.g. increased communication distance and/or allows higher bit rates) of planar loop antenna 110. For an exemplary embodiment of planar loop antenna 110 in accordance with the invention, the dimensions of planar loop antenna 110 are about 30 mm by about 17 mm, where distance 129 is set to about 5 mm and the width of conductors 101 is about 0.4 mm (which is also the spacing between conductors 101). Antenna overlap 155 is the overlap between coils 115 and 125 and is about 5 mm in length for an embodiment in accordance with the invention.

Figure 1C:
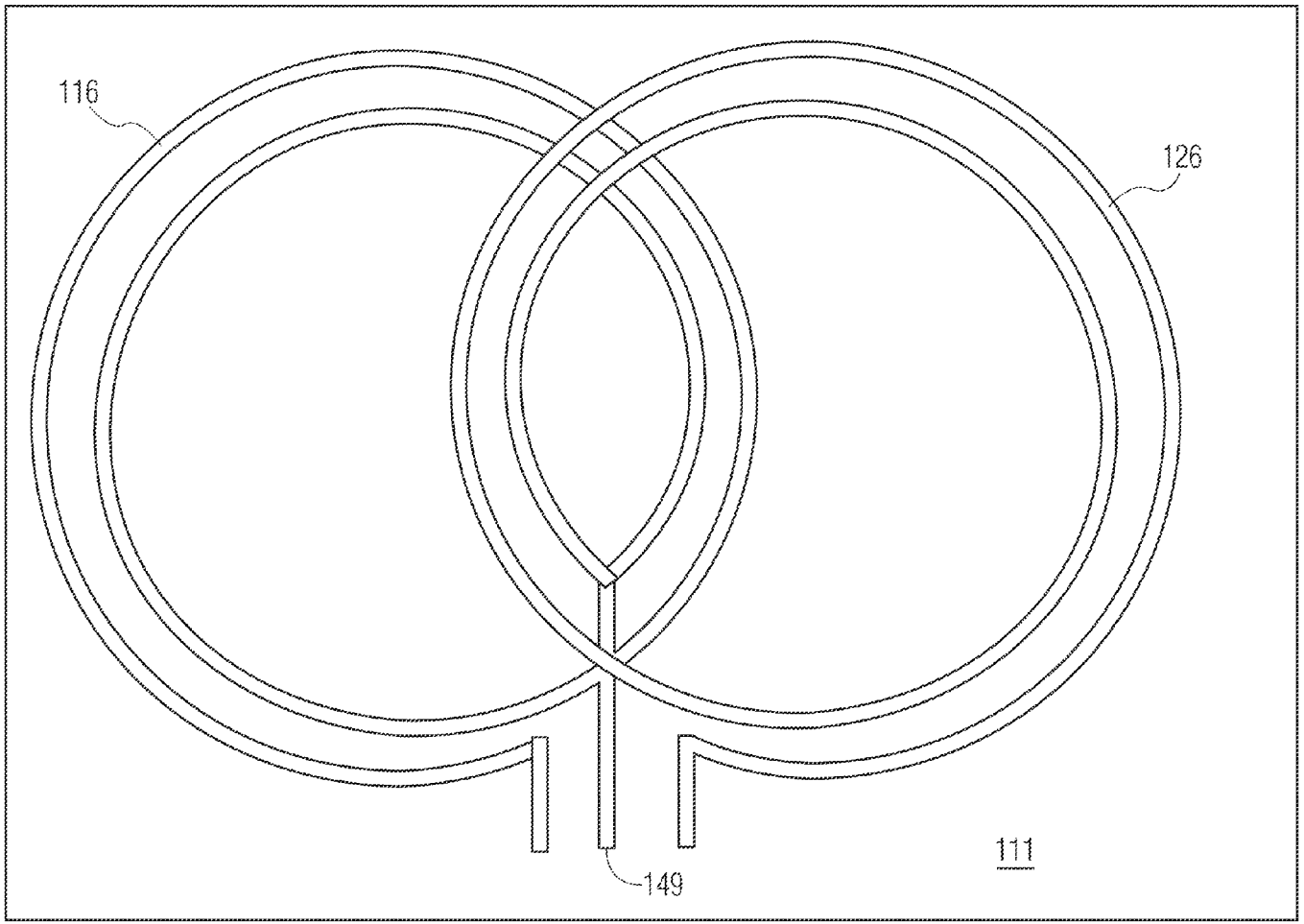
FIG. 1*c* shows an embodiment in accordance with the invention.
Figure 1D:
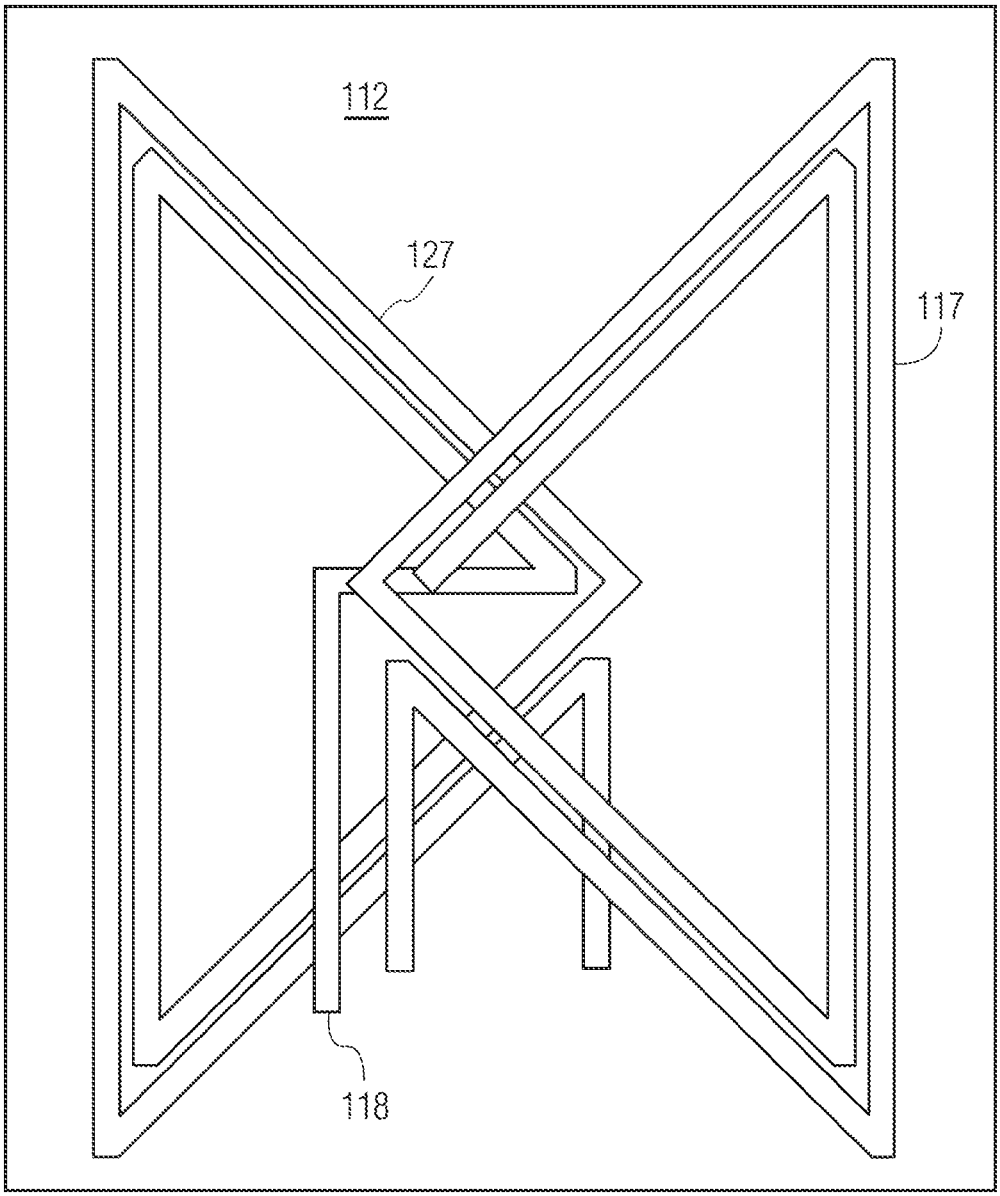
FIG. 1*d* shows an embodiment in accordance with the invention.

FIGS. 1*c* and 1*d* show two geometrical options for planar loop antenna 110 for an embodiment in accordance with the invention. Other geometrical shapes are possible as well for embodiments in accordance with the invention. Planar loop antenna 111 in FIG. 1*c* has a circular geometry with coils 116 and 126. Note the overlapping area between coil 116 and coil 126 and common ground 149 to which both coil 116 and coil 126 are connected. Planar loop antenna 112 has a triangular geometry with coils 117 and 127. Note the overlapping area between coil 117 and coil 127 and common ground 148 to which both coil 117 and coil 127 are connected.

The size for planar loop antenna 110 typically depends on the contactless performance that is desired. For interoperability with products that meet the ISO/IEC14443 standard, geometric size classes are defined. Typically, the largest size is the card format which is specified in ISO/IEC7810 as the ID-1 format which is about 86 mm by about 55 mm. For certain applications, the size may need to be considerably smaller, typically the smallest size would be about 5 mm by about 5 mm in accordance with the invention.

Typically, the width of conductors 101 of coils 115 and 125 is in the rang of about 0.1 mm to about 3 mm for embodiments in accordance with the invention. For typical commercial processes, 0.1 mm is the lower limit on the width resolution. For etching processes, some copper thicknesses are typical. Typically 35 μm, 18 μm and 12 μm are commercially available thicknesses for conductors 110 using an etching process. Electroplating or galvanic processes allow thicknesses on the order of about 1 μm. Thickness is also dependent on the design requirements for the environment where planar loop antenna 110 will be used.

The amount of current typically flowing in conductors 101 of coils 115 and 125 typically requires a certain conductor volume to avoid thermally overloading conductors 101. Typical currents in conductors 101 range from about 10 mA to about 1 A at the exemplary frequency of 13.56 MHz. The skin effect, where only the outer part of the conductor 101 contributes to current conduction, typically operates to increase resistance for high frequency currents. Smaller cross-sectional area for conductors 101 results in higher specific resistance thereby increasing the resistance losses in coils 115 and 125. Typically, a higher resistance for a given inductance lowers the quality factor (Q) of an antenna circuit. Typical values for Q for exemplary embodiments in accordance with the invention are in the range from about 10 to about 40. However, the width of conductors 101 for a given area for planar loop antenna 110 is limited by the requirement that the middle of coils 115 and 125 be conductor free for effective H-field transmission or reception.

The spacing between conductors 101 of coils 115 and 125 is typically determined by the commercially available process which typically results in a spacing between conductors 101 on the order of about 0.1 mm in an embodiment in accordance with the invention. There is a proximity effect between conductors 101 when carrying an AC current. Each trace of conductor 101 produces an H-field which reduces the useable cross-section of conductors 101 for carrying current and increases the effective resistance. The proximity effect increases with frequency and decreases with increased spacing between conductors 101. Hence, a closer spacing of conductors 101 increases the resistance of planar loop antenna 110.

Figure 2A:
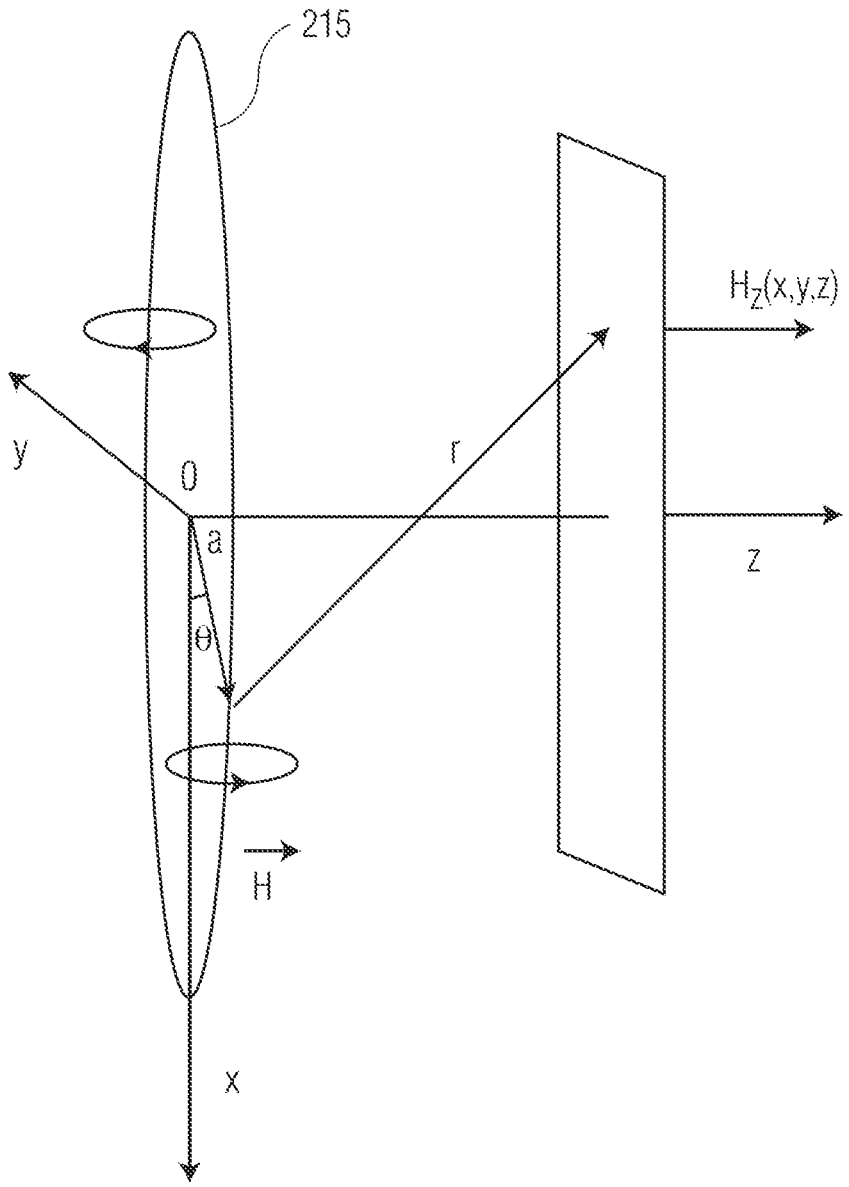
FIG. 2*a* shows the H-field for circular loop antenna.

If an AC current is driven in coil 115, coil 115 emits an H-field. For illustrative purposes, FIG. 2*a* shows the H-field for circular loop antenna 215 which can be calculated using the Biot-Savart law. The radial distance r between the center of circular loop antenna 215 and any point in space is given by:

$$r(x,y,z,\theta)=\sqrt{(a\cos\theta-x)^2+(a\sin\theta-y)^2+z^2} \tag{1}$$

where a is the radius of circular loop antenna 215 and θ is the angle between the radius and the x-axis. The z component of the H-field, $H_z$, can be calculated at any point (x,y,z) using the following equation:

$$H_z(x,\ y,\ z)=\frac{I_A a}{4\pi}\int_0^{2\pi}\left\{\frac{e^{-i\beta r}}{r^2}\left(i\beta+\frac{1}{r}\right)[a-x\cos\theta-y\sin\theta]\right\}d\theta \tag{2}$$

where β is the phase constant $2\pi f_c/c$ and $I_A$ is the current in the antenna.

For coils 115 and 125 of planar loop antenna 110 that have a rectangular shape in an embodiment in accordance with the invention, the H-field is typically computed using High Frequency Structural Simulator (HFSS) available from ANSYS Corporation. Typical operating voltages for the contactless reader antenna are typically in the range of about 30 volts to about 40 volts with a current on the order of several 100 mA.

In a plane parallel and below coil 115, the magnetic flux in the plane under the center of coil 115 has one direction while the magnetic flux in the plane outside of coil 115 points in the opposite direction (e.g. see direction for H-field of circular loop antenna 215 in FIG. 2*a*). The flux density is non-homogeneous. Coil 125 is placed relative to coil 115 in such a way (e.g. see antenna overlap 155 in FIG. 1*b*), that the magnetic flux generated by coils 115 and 125 in one direction is substantially the same as the magnetic flux generated by coils 115 and 125 in the opposite direction so that the magnetic flux substantially cancels and the induced voltage in one coil due to the magnetic field of the other coil is substantially zero. This provides a "zero" coupling antenna in accordance with the invention.

The coupling coefficient k between coils 115 and 125 may be estimated as follows. A constant AC voltage $U_1$ is applied to coil 115 having an inductance $L_1$ and the induced voltage $U_2$ is measured in coil 125 having an inductance $L_2$. Then the coupling coefficient k is given by:

$$k \cong \frac{U_2}{U_1}\sqrt{\frac{L_1}{L_2}} \tag{3}$$

The criteria for a "zero" coupling antenna in accordance with the invention is that k≤10%.

In the active card mode operation of a transceiver device, such as a Near Field Communication (NFC) device, planar loop antenna 110 is connected to the integrated circuit chip comprising the driver circuit (e.g. an NFC chip) such that common ground 150 is connected to connection point 130 between coils 115 and 125. The driver output of the integrated circuit is connected to common ground 150 and end pad 135 of coil 115 and is used to drive the active load modulation signal. The receiver input of the integrated circuit is connected to common ground 150 and end pad 145 of coil 125 and is used to sense the 13.56 MHz carrier phase of the contactless reader.

Figure 2B:
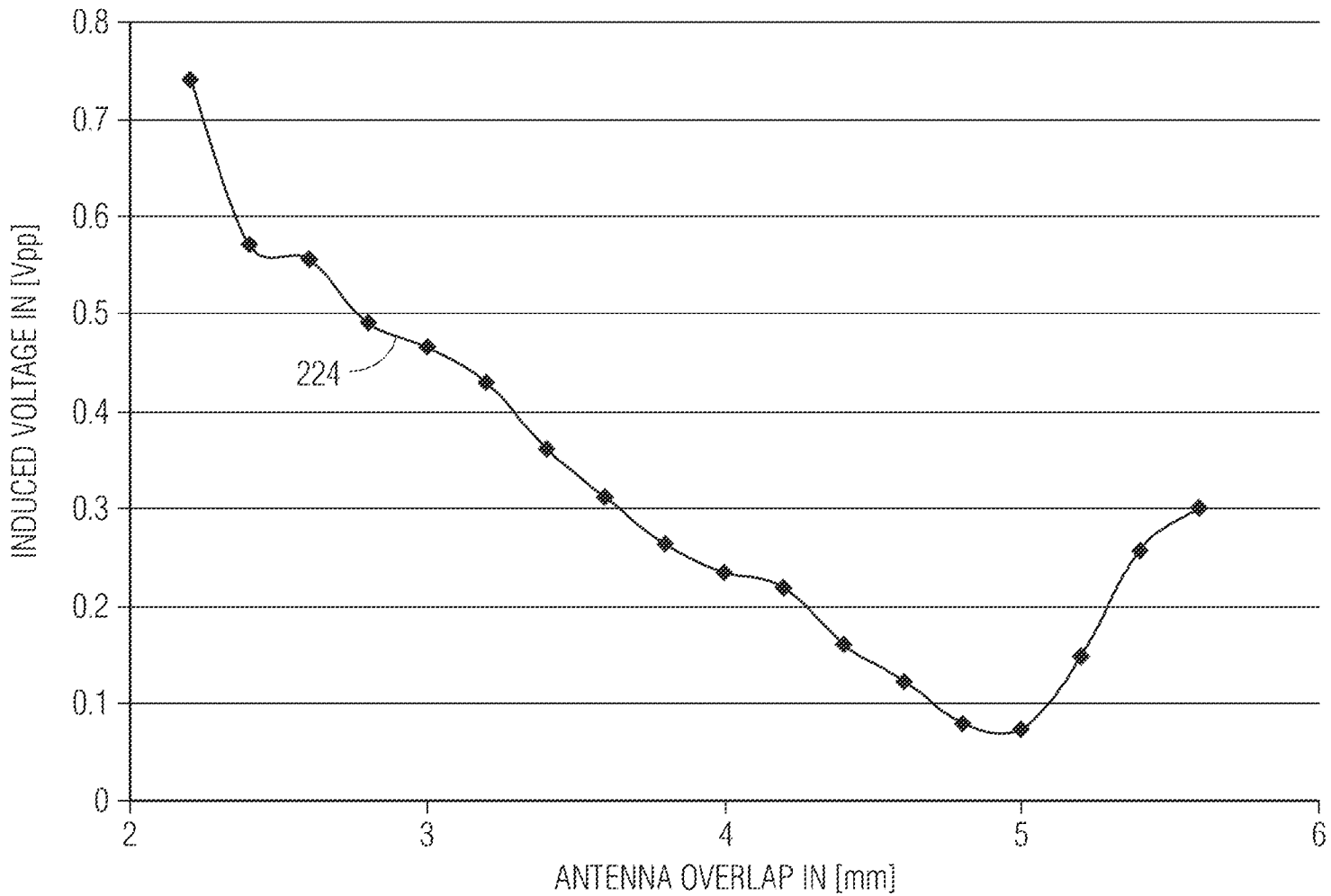
FIG. 2*b* shows induced voltage as a function of antenna overlap in accordance with the invention.

FIG. 2*b* shows induced voltage (Vpp) 224 in coil 125 (see FIG. 1*b*) as measured between common ground 150 and end pad 145 due to the 13.56 MHz driver output fed into coil 115 as a function of antenna overlap 155 (length of overlap between coils 115 and 125) for planar loop antenna 110. The driver output is connected between common ground 150 and end pad 135 (see FIG. 1*b*) and applying an alternating current of 60 mA (rms) for the example shown in FIG. 2*b*. FIG. 2*b* is used to determine the overlap 155 between antenna 115 and 125 that produces the minimum coupling between coils 115 and 125 (i.e. the minimum induced voltage in coil 125). Here, planar loop antenna 110 has exemplary dimensions of about 30 mm by about 17 mm with each coil 115 and 125 having dimensions of about 17.5 mm by about 17 mm. Induced voltage 224 in FIG. 2*b* is shown to have a minimum for antenna overlap 155 being about 5 mm which results in about a 29% overlap in area between coils 115 and 125.

To make planar loop antenna 110 insensitive to the influence of metallic objects nearby and thereby reduce unwanted harmonic emissions a layered structure (see FIGS. 3 and 4) is typically used for planar loop antenna 110.

FIGS. 3*a-h* and FIG. 4 in a side view show the layers of an embodiment of planar loop antenna 110 in an embodiment in accordance with the invention. In an embodiment in accordance with the invention, the layers may be connected to each other using an adhesive or, in another embodiment in accordance with the invention, the layers may be laminated together using typical lamination processes used to make smartcards.

Figure 3A:
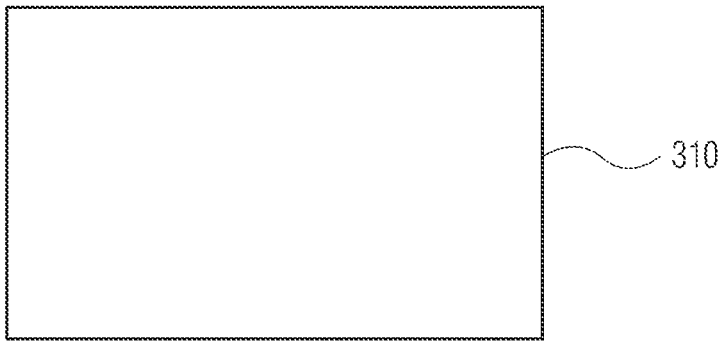
FIGS. 3*a-h* shows the separate layers of an embodiment in accordance with the invention in top view.
Figure 4:
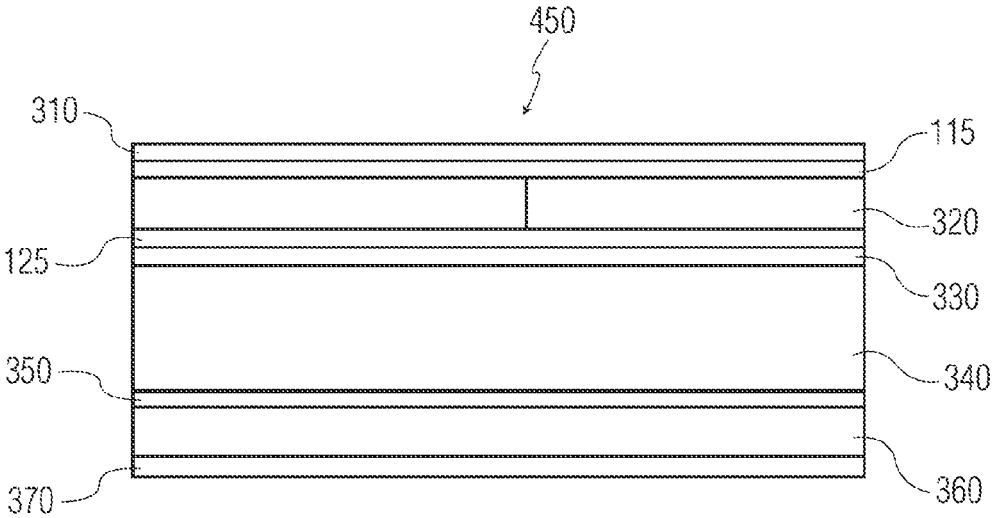
FIG. 4 shows the layers of an embodiment in accordance with the invention in side view.

FIG. 3*a* shows top adhesive layer 310 which typically is an adhesive layer made from FASSON S490 adhesive, for example and having a typical thickness of about 10 μm. Top adhesive layer 310 allows planar loop antenna 110 to be easily mounted on the inside of a device such as a smartphone. Alternatively, top adhesive layer 310 may be a foil such as polyethylene terephthalate (PET) with an adhesive such as FASSON S490 being applied to both sides of the foil. Selection of the adhesive material for layer 310 is typically important as the properties of the adhesive should not adversely impact the H-field such as producing absorption of the H-field.

Figure 3B:
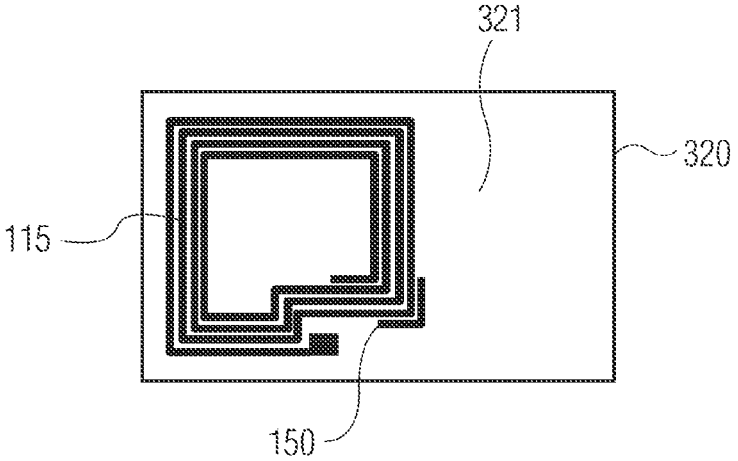
Figure 3C:
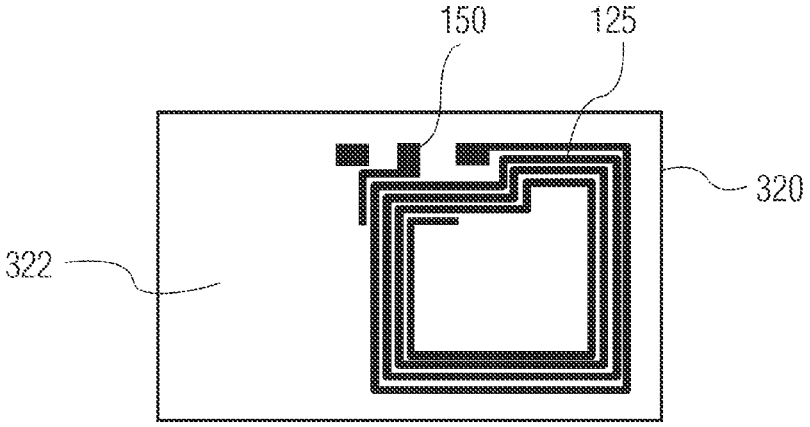

FIG. 3*b* shows coil antenna 115 having a typical thickness of about 18 μm, typically made from a conductive material such as copper on face 321 of substrate 320. Substrate layer 320 is typically made from polyethylene terephthalate (PET) foil having a typical thickness of about 38 μm. Alternatively, substrate layer 320 may be made of PVC. In accordance with the invention, it is typically desirable to have the coil antenna 115 and coil antenna 125 lying in parallel planes that have minimal vertical separation from one another. FIG. 3*c* shows coil antenna 125 which is on opposite face 322 of substrate 320 from face 321.

Coil antennas 115 and 125 may be etched antennas, wire antennas, galvano-antennas or printed antennas. For example, for etched antennas, substrate 320 made of PVC having a copper layer (typical thickness of about 1.8 μm) on both sides of substrate 320 may be used. Photoresist material is placed over the copper layers on each side of substrate 320. A photographic process then projects the antenna coil layout onto the photoresist residing on top of the copper layers on each side of substrate 320. Using a chemical process, the exposed photoresist is removed, leaving the layout for coils 115 and 125 in the copper layers. A chemical etch then removes the exposed copper leaving only the copper layouts covered by the photoresist material. The photoresist is then chemically removed to yield planar coils 115 and 125. Coil antennas 115 and 125 may be electrically connected by drilling a hole and filling the hole with conductive paste to create connection 150.

Figure 3D:
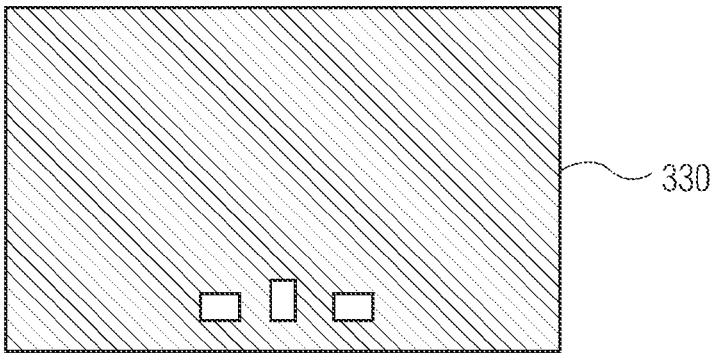
Figure 3E:
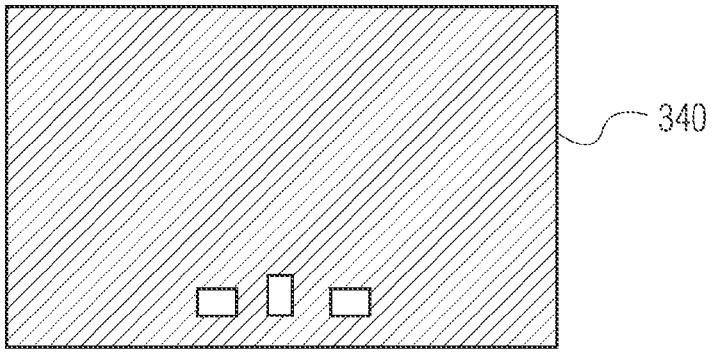

FIG. 3*d* shows second adhesive layer 330 having a typical thickness of about 10 μm and typically made from the same material and the same thickness as top adhesive layer 310. FIG. 3*e* shows ferrite layer 340 with a typical thickness of about 100 μm and is typically a ferrite foil such as FSF161 (available from MARUWA Co., Ltd. of Japan) which has a real part relative permeability of about 135 and an imaginary part relative permeability less than about 10 at 13.56 MHz. Hence, ferrite layer 340 has a higher magnetic permeability than air and acts to block (magnetic shielding) the H-field from passing through it. This is useful if planar loop antenna 110 is to be positioned over a metal area, such as a battery pack in a smart phone. Without ferrite layer 340, a metal area proximate to the antenna would typically significantly attenuate the 13.56 MHz alternating H-field. Note that ferrite layer 340 increases the inductance of the antenna equivalent circuit and so has to be taken into account for the antenna matching. More information regarding the effects and design of a ferrite layer, in particular for use in an NFC transponder, may be found in "Design of 13.56 MHz Smartcard Stickers with Ferrite for Payment and Authentication", Near Field Communication (NFC), 2011 3rd International Workshop on, pages 59-64, 2011, which is incorporated herein by reference in its entirety.

Figure 3F:
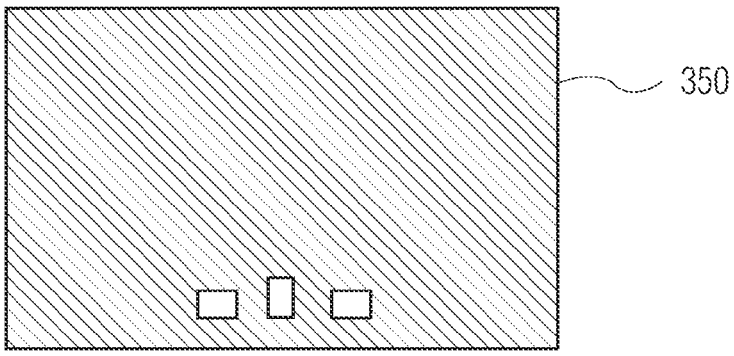
Figure 3G:
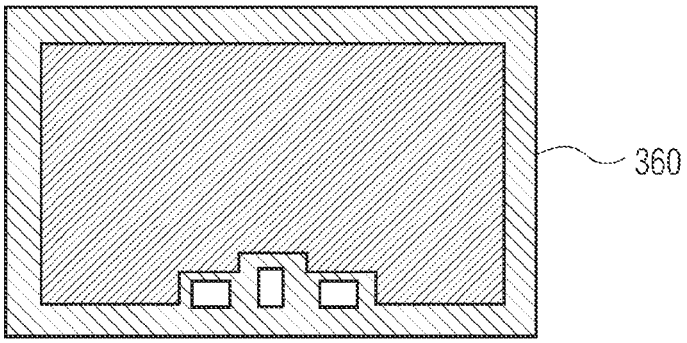

FIG. 3*f* shows third adhesive layer 350 having a thickness of about 10 μm and typically made from the same material as top adhesive layer 310. FIG. 3*g* shows second substrate layer 360 having a typical thickness of about 38 μm.

Figure 3H:
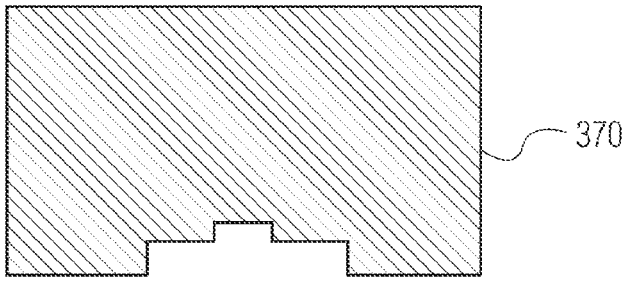

Finally, FIG. 3*h* shows metal shield layer 370 having a typical thickness of about 18 μm attached underneath second substrate 360. Metal shield 370 is typically made from aluminum or copper. Metal shield layer 370 makes planar loop antenna 110 more resistant against de-tuning caused by the presence or absence of various materials behind planar loop antenna 110 as ferrite layer 340 only blocks a portion of the H-field and part of the H-field passes through ferrite layer 340. The presence or absence of metal (e.g. battery pack) changes the equivalent circuit element values of planar loop antenna 110. For example, if a fixed matching network is used to match planar loop antenna impedance at a frequency of 13.56 MHz to the integrated circuit amplifier output impedance, the result would be an impedance mismatch. Metal shield layer 370 is already taken into account by the fixed matching network so planar loop antenna 110 is less sensitive to the presence or absence of nearby metal objects. Additionally, metal shield layer 370 provides shielding from electrical fields from other parts of the transponder device or contactless reader at the cost of a reduction in contactless performance. The reduction in contactless performance typically results because the H-field penetrating through ferrite layer 340 produces eddy currents in metal shield layer 370 that generate H-fields that oppose the applied H-field, resulting in an overall reduction of the applied H-field.

Figure 5A:
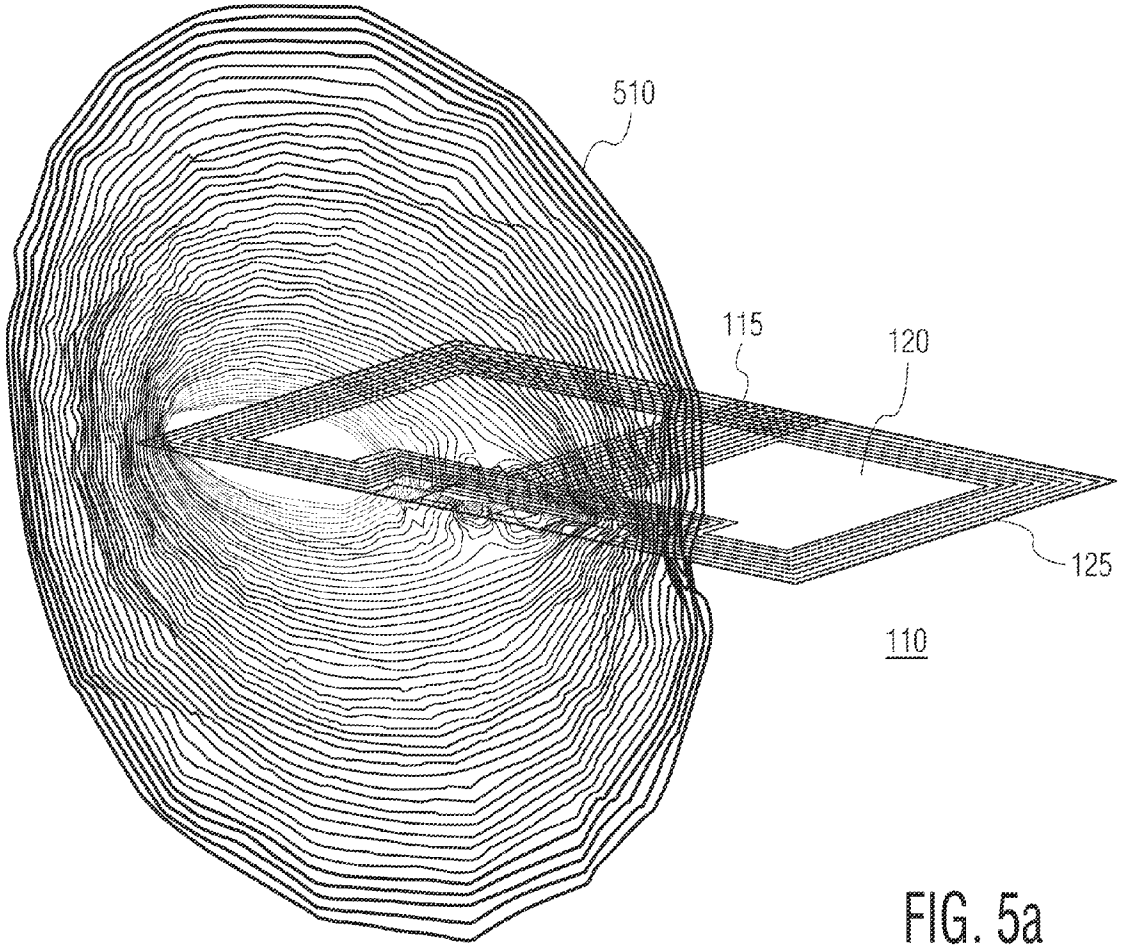
FIG. 5*a* shows the contours of the H-field in cross-sectional plane perpendicular to an embodiment in accordance with the invention.
Figure 5B:
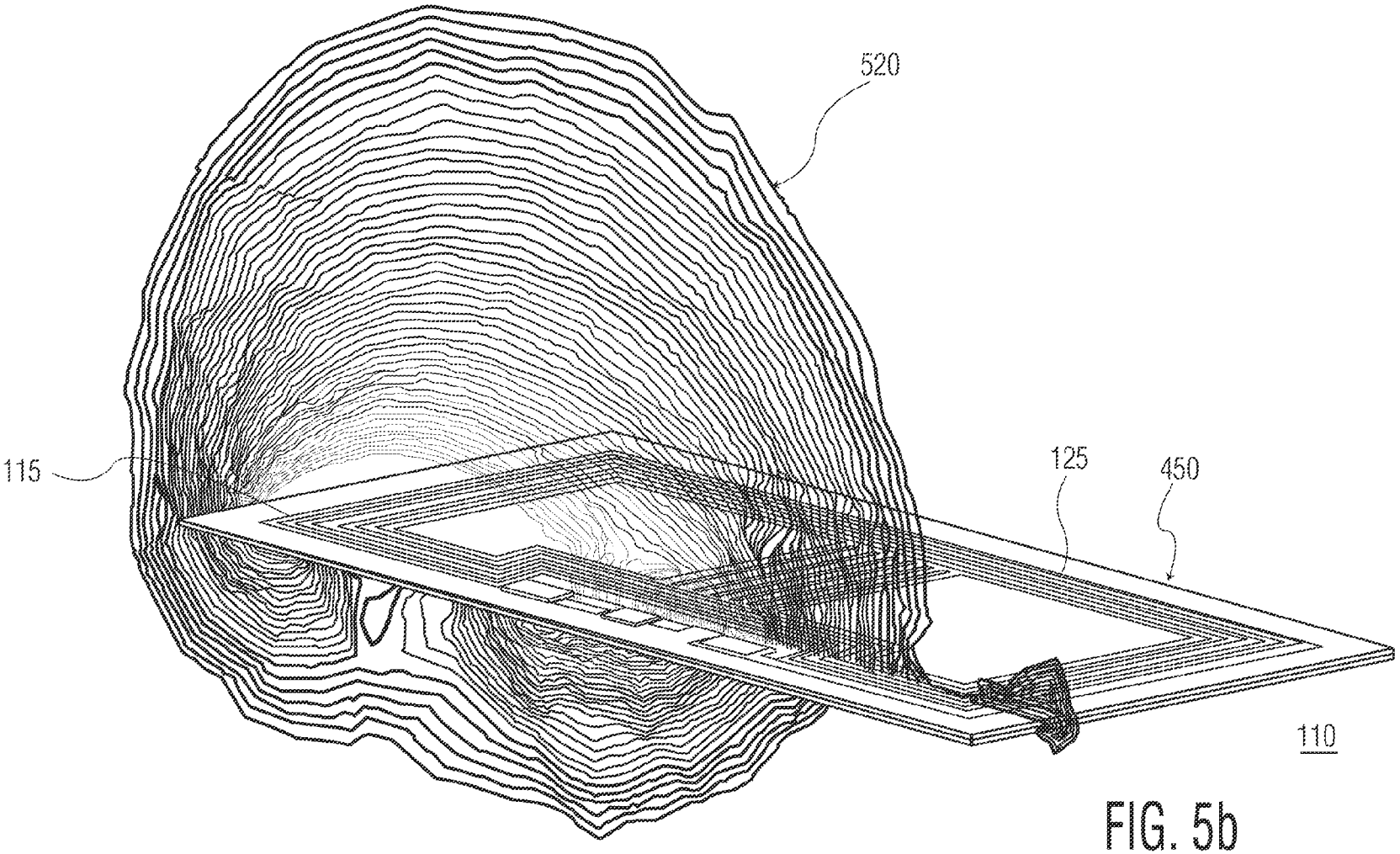
FIG. 5*b* shows the contours of the H-field in cross-sectional plane perpendicular to an embodiment in accordance with the invention.

The layer structure of planar loop antenna 110 in accordance with the invention also provides directionality as the H-field emission occurs preferentially in the direction away from metal shield layer 370 as shown in FIGS. 5*a* and 5*b*. FIG. 5*a* shows the contours of H-field 510 in cross-sectional plane perpendicular to coils 115 and 125. H-field 510 in FIG. 5*a* is the magnetic H field for coils 115 and 125 separated by substrate 120 without any additional layers and H-field 510 is symmetrical about substrate 120. H-field 520 in FIG. 5*b* is the magnetic H field for coils 115 and 125 using layer structure 450 shown in FIGS. 4 and 3*a-h*. In contrast to H-field 510 in FIG. 5*a*, H-field 520 in FIG. 5*b* is asymmetric with H-field 520 being stronger above layer structure 450 and weaker below layer structure 450. This asymmetry is typically due to the presence of metal shield layer 370 and ferrite layer 340 in layer structure 450 which typically function as magnetic shields.

While the invention has been described in conjunction with specific embodiments, it is evident to those skilled in the art that many alternatives, modifications, and variations will be apparent in light of the foregoing description. Accordingly, the invention is intended to embrace all other such alternatives, modifications, and variations that fall within the spirit and scope of the appended claims.

The invention claimed is:

1. An active load modulation antenna structure comprising:

a first loop antenna having an outer perimeter that defines a first area on a first face of a substrate having an area, the first loop antenna having two ends with a ground pad at one end and a driver pad at the other end, the driver pad for driving an active load signal; and a second loop antenna having an outer perimeter that defines a second area on a second face opposite to the first face of the substrate, the second loop antenna having two ends with the ground pad at one end and a receiver pad at the other end, the receiver pad for receiving a carrier signal, the ground pad being common to both the first loop antenna and the second loop antenna;

wherein the driver pad, the receiver pad, and the ground pad are on the same side of the substrate for connection to an integrated circuit;

wherein the outer perimeter of the first loop antenna is the same as the outer perimeter of the second loop antenna and the first area is the same as the second area;

wherein the outer perimeter of the second loop antenna is displaced a lateral distance, relative to the first face and the second face of the substrate, from the outer perimeter of the first loop antenna to define an overlapping area of the first area with the second area that is less than the first area and less than the second area;

wherein the first loop antenna operates to transmit the active load signal and the second loop antenna operates to receive the carrier signal.

2. The active load modulation antenna structure of claim 1 further comprising a ferrite foil positioned below the first and second loop antennas.

3. The active load modulation antenna structure of claim 1 further comprising a metal shield positioned below the first and second loop antennas.

4. The active load modulation antenna structure of claim 2 further comprising a metal shield positioned below the ferrite foil.

5. The active load modulation antenna structure of claim 4 further comprising an adhesive layer between the substrate and the ferrite foil.

6. The active load modulation antenna structure of claim 2 wherein the ferrite foil has an area larger than the substrate area.

7. The active load modulation antenna of claim 1 wherein the first and second loop antennas are comprised of metal traces.

8. The active load modulation antenna structure of claim 1 wherein the substrate is comprised of polyethylene terephthalate (PET) foil.

9. A transceiver device comprising the active load modulation antenna structure of claim 1.

10. The transceiver device of claim 9 wherein the device is part of a cellular phone.

11. The transceiver device of claim 9 wherein the transceiver device is a Near Field Communication (NFC) device.

12. A system comprising a transponder and a reader wherein the transponder and reader each comprise the active load modulation antenna of claim 1.

13. The system of claim 12 wherein the transponder and the reader communicate with each other using NFC.

14. The load modulation antenna structure of claim 1 wherein the lateral distance is a lateral distance at which the magnetic flux generated by the first antenna in one direction is substantially the same as the magnetic flux generated by the second antenna in the opposite direction so that the magnetic flux generated by the first antenna and the magnetic flux generated by the second antenna substantially cancel each other to provide a zero coupling antenna structure, wherein a coupling coefficient between the first antenna and the second antenna is less than about ten percent, wherein the coupling coefficient is given by:

$$k \cong \frac{U_2}{U_1}\sqrt{\frac{L_1}{L_2}}$$

where $U_1$ is a constant AC voltage applied to the first antenna having an inductance $L_1$ and $U_2$ is the induced voltage measured in the second antenna having an inductance $L_2$.

15. A method for making an active load modulation antenna structure comprising:

providing a first loop antenna having an outer perimeter that defines a first area on a first face of a substrate having an area, the first loop antenna having two ends with a ground pad at one end and a driver pad at the other end, the driver pad for driving an active load signal; and providing a second loop antenna having an outer perimeter that defines a second area on a second face opposite to the first face of the substrate, the second loop antenna having two ends with the ground pad at one end and a receiver pad at the other end, the receiver pad for receiving a carrier signal, the ground pad being common to both the first loop antenna and the second loop antenna;

wherein the driver pad, the receiver pad, and the ground pad are on the same side of the substrate for connection to an integrated circuit;

wherein the outer perimeter of the first loop antenna is the same as the outer perimeter of the second loop antenna and the first area is the same as the second area;

wherein the outer perimeter of the second loop antenna is displaced, relative to the first face and the second face of the substrate, a lateral distance from the outer perimeter of the first loop antenna to define an overlapping area of the first area with the second area that is less than the first area and less than the second area;

wherein the first loop antenna operates to transmit the active load signal and the second loop antenna operates to receive the carrier signal.

16. The method of claim 15 further comprising a positioning a ferrite foil below the first and second loop antennas.

17. The method of claim 16 further comprising positioning a metal shield below the ferrite foil.

18. The method of claim 15 wherein the ferrite foil has an area larger than the substrate area.

19. The method of claim 15 wherein the substrate is comprised of polyethylene terephthalate (PET) foil.

20. An active load modulation antenna structure comprising:

a first loop antenna having a first area on a first face of a substrate having an area, the first loop antenna having two ends with a ground pad at one end and a driver pad at the other end, the driver pad for driving an active load signal; and a second loop antenna having a second area on a second face opposite to the first face of the substrate, the second loop antenna having two ends with the ground pad at one end and a receiver pad at the other end, the receiver pad for receiving a carrier signal, the ground pad being common to both the first loop antenna and the second loop antenna;

wherein the driver pad, the receiver pad, and the ground pad are on the same side of the substrate for connection to an integrated circuit;

wherein the second loop antenna is displaced a lateral distance, relative to the first face and the second face of the substrate, from the first loop antenna to define an overlapping area of the first area with the second area that is less than the first area and less than the second area;

wherein the lateral distance is a lateral distance at which the magnetic flux generated by the first loop antenna in one direction is substantially the same as the magnetic flux generated by the second loop antenna in the opposite direction so that the magnetic flux generated by the first loop antenna and the magnetic flux generated by the second loop antenna substantially cancel each other;

wherein the first loop antenna operates to transmit the active load signal and the second loop antenna operates to receive the carrier signal.

* * * * *